US006646637B1

(12) United States Patent
Kageyama et al.

(10) Patent No.: US 6,646,637 B1
(45) Date of Patent: Nov. 11, 2003

(54) LIQUID CRYSTAL DISPLAY DEVICE

(75) Inventors: Hiroshi Kageyama, Hitachi (JP); Hideo Sato, Hitachi (JP); Yoshiro Mikami, Hitachioota (JP)

(73) Assignee: Hitachi, Ltd., Tokyo (JP)

( * ) Notice: Subject to any disclaimer, the term of this patent is extended or adjusted under 35 U.S.C. 154(b) by 425 days.

(21) Appl. No.: 09/709,434

(22) Filed: Nov. 13, 2000

(30) Foreign Application Priority Data

Feb. 29, 2000 (JP) ..... 2000-054958

(51) Int. Cl.[7] ..... G09G 5/00
(52) U.S. Cl. ..... 345/204; 87/92
(58) Field of Search ..... 345/87, 88, 90, 345/92, 95, 99, 100, 104, 204, 205, 206, 210, 211, 214; 349/149–152

(56) References Cited

U.S. PATENT DOCUMENTS 6,191,779 B1 * 2/2001 Taguchi et al. ..... 345/204
6,225,931 B1 * 5/2001 Rao et al. ..... 341/144
6,373,459 B1 * 4/2002 Jeong ..... 345/100
6,392,354 B1 * 5/2002 Matsueda ..... 315/169.1
6,411,273 B1 * 6/2002 Nakamura et al. ..... 345/98
6,424,328 B1 * 7/2002 Ino et al. ..... 345/87

* cited by examiner

*Primary Examiner*—Vijay Shankar
*Assistant Examiner*—Mansour M. Said
(74) *Attorney, Agent, or Firm*—Antonelli, Terry, Stout & Kraus, LLP

(57) ABSTRACT

Each of a plurality of D/A conversion circuits DA1~DA4 is constituted by a plurality of switching thin film transistors (TFTs), each having substantially the same ON resistance, and a control circuit performing ON and OFF control of the switching TFTs in such a manner that, during a D/A conversion operation a predetermined same plural number of switching TFTs are turned ON for any digital input signal representing gradations to be displayed, thereby, the output resistance of each of the D/A conversion circuits is kept substantially constant. Accordingly, multi-gradation and high resolution of a liquid display device are easily achieved and the image quality thereof is improved.

26 Claims, 13 Drawing Sheets

FIG. 3

| EN | Data | S1 | S2 | S3 | S4 | S5 | S6 | S7 | S8 | S9 | S10 | S11 | S12 | S13 | S14 | S15 | S16 | S17 | S18 | S19 |
|---|---|---|---|---|---|---|---|---|---|---|---|---|---|---|---|---|---|---|---|---|
| 1 | 0 | ○ | ○ | ○ | ○ | | | | | | | | | | | | | | | |
| 1 | 1 | | ○ | ○ | ○ | ○ | | | | | | | | | | | | | | |
| 1 | 2 | | | ○ | ○ | ○ | ○ | | | | | | | | | | | | | |
| 1 | 3 | | | | ○ | ○ | ○ | ○ | | | | | | | | | | | | |
| 1 | 4 | | | | | ○ | ○ | ○ | ○ | | | | | | | | | | | |
| 1 | 5 | | | | | | ○ | ○ | ○ | ○ | | | | | | | | | | |
| 1 | 6 | | | | | | | ○ | ○ | ○ | ○ | | | | | | | | | |
| 1 | 7 | | | | | | | | ○ | ○ | ○ | ○ | | | | | | | | |
| 1 | 8 | | | | | | | | | ○ | ○ | ○ | ○ | | | | | | | |
| 1 | 9 | | | | | | | | | | ○ | ○ | ○ | ○ | | | | | | |
| 1 | 10 | | | | | | | | | | | ○ | ○ | ○ | ○ | | | | | |
| 1 | 11 | | | | | | | | | | | | ○ | ○ | ○ | ○ | | | | |
| 1 | 12 | | | | | | | | | | | | | ○ | ○ | ○ | ○ | | | |
| 1 | 13 | | | | | | | | | | | | | | ○ | ○ | ○ | ○ | | |
| 1 | 14 | | | | | | | | | | | | | | | ○ | ○ | ○ | ○ | |
| 1 | 15 | | | | | | | | | | | | | | | | ○ | ○ | ○ | ○ |
| 1 | x | | | | | | | | | | | | | | | | | | | |

x ... Don't care ○ =ON □ =OFF

Data=4×k

Vout=Vk
Output resistance=R/4

Data=4×k+1

Vout=(3×Vk+Vk+1)/4
Output resistance=R/4

Data=4×k+2

Vout=(Vk+Vk+1)/2
Output resistance=R/4

Data=4×k+3

Vout=(Vk+3×Vk+1)/4
Output resistance=R/4

⊗ ...ON
⊗ ...OFF

SGk :R+r/2
SGk+1 :R-r/2

SGk :R-r/2
SGk+1 :R+r/2

| EN | S | Data | S1 | S2 | S3 | S4 | S5 | S6 | S7 | S8 | S9 | S10 | S11 | S12 | S13 | S14 | S15 | S16 | S17 | S18 | S19 |
|---|---|---|---|---|---|---|---|---|---|---|---|---|---|---|---|---|---|---|---|---|---|
| 1 | 0 | 0 | ○ | ○ | ○ | ○ | | | | | | | | | | | | | | | |
| | | 1 | | ○ | ○ | ○ | ○ | | | | | | | | | | | | | | |
| | | 2 | | | ○ | ○ | ○ | ○ | | | | | | | | | | | | | |
| | | 3 | | | | ○ | ○ | ○ | ○ | | | | | | | | | | | | |
| | | 4 | | | | | ○ | ○ | ○ | ○ | | | | | | | | | | | |
| | | 5 | | | | | | ○ | ○ | ○ | ○ | | | | | | | | | | |
| | | 6 | | | | | | | ○ | ○ | ○ | ○ | | | | | | | | | |
| | | 7 | | | | | | | | ○ | ○ | ○ | ○ | | | | | | | | |
| | | 8 | | | | | | | | | ○ | ○ | ○ | ○ | | | | | | | |
| | | 9 | | | | | | | | | | ○ | ○ | ○ | ○ | | | | | | |
| | | 10 | | | | | | | | | | | ○ | ○ | ○ | ○ | | | | | |
| | | 11 | | | | | | | | | | | | ○ | ○ | ○ | ○ | | | | |
| | | 12 | | | | | | | | | | | | | ○ | ○ | ○ | ○ | | | |
| | | 13 | | | | | | | | | | | | | | ○ | ○ | ○ | ○ | | |
| | | 14 | | | | | | | | | | | | | | | ○ | ○ | ○ | ○ | |
| | | 15 | | | | | | | | | | | | | | | | ○ | ○ | ○ | ○ |
| | 1 | 0-3 | ○ | ○ | ○ | ○ | | | | | | | | | | | | | | | |
| | | 4-7 | | | | | ○ | ○ | ○ | ○ | | | | | | | | | | | |
| | | 8-11 | | | | | | | | | ○ | ○ | ○ | ○ | | | | | | | |
| | | 12-15 | | | | | | | | | | | | | ○ | ○ | ○ | ○ | | | |
| 0 | x | x | | | | | | | | | | | | | | | | | | | |

x ...Don't Care ○ =ON □ =OFF

| Data | S1 | S2 | S3 | S4 | S5 | S6 | S7 | S8 | S9 | S10 | S11 | S12 | S13 | S14 | S15 | S16 | S17 | S18 | S19 |
|---|---|---|---|---|---|---|---|---|---|---|---|---|---|---|---|---|---|---|---|
| 0 | ○ | ○ | ○ | ○ | | | | | | | | | | | | | | | |
| 1 | | ○ | ○ | ○ | ○ | | | | | | | | | | | | | | |
| 2 | | | ○ | ○ | ○ | ○ | | | | | | | | | | | | | |
| 3 | | | | ○ | ○ | ○ | ○ | | | | | | | | | | | | |
| 4 | | | | | ○ | ○ | ○ | ○ | | | | | | | | | | | |
| 5 | | | | | | ○ | ○ | ○ | ○ | | | | | | | | | | |
| 6 | | | | | | | ○ | ○ | ○ | ○ | | | | | | | | | |
| 7 | | | | | | | | ○ | ○ | ○ | ○ | | | | | | | | |
| 8 | | | | | | | | | ○ | ○ | ○ | ○ | | | | | | | |
| 9 | | | | | | | | | | ○ | ○ | ○ | ○ | | | | | | |
| 10 | | | | | | | | | | | ○ | ○ | ○ | ○ | | | | | |
| 11 | | | | | | | | | | | | ○ | ○ | ○ | ○ | | | | |
| 12 | | | | | | | | | | | | | ○ | ○ | ○ | ○ | | | |
| 13 | | | | | | | | | | | | | | ○ | ○ | ○ | ○ | | |
| 14 | | | | | | | | | | | | | | | ○ | ○ | ○ | ○ | |
| 15 | | | | | | | | | | | | | | | | ○ | ○ | ○ | ○ |

○ =ON  □ =OFF

FIG. 14

| S | Data | S1 | S2 | S3 | S4 | S5 | S6 | S7 | S8 | S9 | S10 | S11 | S12 | S13 | S14 | S15 | S16 | S17 | S18 | S19 |
|---|---|---|---|---|---|---|---|---|---|---|---|---|---|---|---|---|---|---|---|---|
| 0 | 0 | ○ | ○ | ○ | ○ | | | | | | | | | | | | | | | |
| | 1 | | ○ | ○ | ○ | ○ | | | | | | | | | | | | | | |
| | 2 | | | ○ | ○ | ○ | ○ | | | | | | | | | | | | | |
| | 3 | | | | ○ | ○ | ○ | ○ | | | | | | | | | | | | |
| | 4 | | | | | ○ | ○ | ○ | ○ | | | | | | | | | | | |
| | 5 | | | | | | ○ | ○ | ○ | ○ | | | | | | | | | | |
| | 6 | | | | | | | ○ | ○ | ○ | ○ | | | | | | | | | |
| | 7 | | | | | | | | ○ | ○ | ○ | ○ | | | | | | | | |
| | 8 | | | | | | | | | ○ | ○ | ○ | ○ | | | | | | | |
| | 9 | | | | | | | | | | ○ | ○ | ○ | ○ | | | | | | |
| | 10 | | | | | | | | | | | ○ | ○ | ○ | ○ | | | | | |
| | 11 | | | | | | | | | | | | ○ | ○ | ○ | ○ | | | | |
| | 12 | | | | | | | | | | | | | ○ | ○ | ○ | ○ | | | |
| | 13 | | | | | | | | | | | | | | ○ | ○ | ○ | ○ | | |
| | 14 | | | | | | | | | | | | | | | ○ | ○ | ○ | ○ | |
| | 15 | | | | | | | | | | | | | | | | ○ | ○ | ○ | ○ |
| 1 | 0-3 | ○ | ○ | ○ | ○ | | | | | | | | | | | | | | | |
| | 4-7 | | | | | ○ | ○ | ○ | ○ | | | | | | | | | | | |
| | 8-11 | | | | | | | | | ○ | ○ | ○ | ○ | | | | | | | |
| | 12-15 | | | | | | | | | | | | | ○ | ○ | ○ | ○ | | | |

○ =ON □ =OFF

LIQUID CRYSTAL DISPLAY DEVICE

BACKGROUND OF THE INVENTION

The present invention relates to a liquid crystal display device which incorporates a peripheral circuit and which is designed to receive a digital signal input.

A conventional technique for production of multi-gradation display for a liquid crystal display device is, for example, disclosed in JP-A-5-333817 (1993).

FIGS. 16A through 16D of the accompanying drawings are views which may be used to illustrate a principle of operation of a D/A conversion circuit which is driven with less reference voltages than the number of gradations to be output, in accordance with the technique disclosed in the above-referenced patent document. With this D/A conversion circuit, five gradation voltages are generated at an output VX from two reference voltages VA and VB.

In the drawings, a switch 91 is a low resistance switch and a switch 92 is a high resistance switch. In the D/A conversion circuit, through control of the switches 91 and 92 as shown in FIGS. 16A through 16D, voltages formed by equally dividing the reference voltages VA and VB by four are outputted with respect to the lowest two bits (D1, D0) of input signal representing gradations to be displayed.

By making use of the circuit arrangement as shown in FIGS. 16A through 16D, the D/A conversion circuit can be driven with less reference voltages than the number of gradations to be outputted. Further, by reducing the number of low resistance switches, which require a large area on a semiconductor chip, the area occupied by a driving circuit is reduced, and, thus, the non-display area in the liquid crystal display device can be reduced.

However, with respect to the conventional technique disclosed in the above-referenced patent document, when the D/A conversion circuit is constituted by parallel circuits of high resistance switches and low resistance switches for more than two reference voltages, the output resistance of the D/A conversion circuit varies depending on the input signals representing gradations to be displayed.

Further, at the output portion of the D/A conversion circuit, load capacitances exist, including an OFF capacitance and an ON capacitance, formed by the switches constituting the D/A conversion circuit and the capacitance of a drain line, therefore, these capacitances also need to be driven. Further, these capacitances are independent from the input signals representing gradations to be displayed and are substantially invariable.

When the D/A conversion circuit drives such a capacitance load, a short voltage or a yet attainable margin defined by an attenuation characteristic approximated by a primary order exponential function is induced in the output voltage with respect to a varying input voltage. FIG. 17 is a graph representing the relationship between short voltage/varying input voltage and conversion time. In FIG. 17, the abscissa represents the D/A conversion time and the ordinate represents the short voltage/varying input voltage as a logarithm. The inclination of the attenuation is determined by a product of the load capacitance and the output resistance and varies depending on the output resistance. FIG. 17 illustrates the difference in attenuation when the output resistance shows the maximum value (R max) and the minimum value (R min), and, as will be observed from the drawing, the two inclinations of attenuation are different. For this reason, although the absolute value of the short voltage decreases in dependance on the lapse of the D/A conversion time, the relative ratios of short voltages/varying input voltages when the output resistances are large and small increase in contrast thereto.

In the above instance, when it is assumed that an allowable short voltage is, for example, about 16 mV for a typical varying input voltage of about 8V, it was necessary in a conventional liquid crystal display device to set a conversion time lower limit Tc and the maximum value Rmax of the switch ON resistance so that the ratio of the short voltage assumes a value below 0.002.

On the other hand, in order to achieve a high resolution, it is necessary to shorten the D/A conversion time as much as possible. However, when there is, for example, a two times difference between the maximum value Rmax and the minimum value Rmin of the output resistance of the D/A conversion circuit, the inclinations of the straight lines become double. In this instance, the ratio of the short voltage 0.002 as it is for the maximum resistance Rmax at the D/A conversion lower limit Tc roughly corresponds to the unevenness or variation of the short voltage, in that it is 16 mV. Since the unevenness in the short voltage appears depending on the gradations, if the D/A conversion time is shortened from the D/A conversion lower limit Tc, this may lead to deterioration of the picture quality because of voltage interval variation between adjacent gradations.

Further, in order to achieve a multi-gradation display, it is required to decrease the unevenness of the short voltage, however, for fulfilling such a requirement, it is necessary to prolong the D/A conversion time.

SUMMARY OF THE INVENTION

An object of the present invention is to provide a liquid crystal display device in which the output resistance of a D/A conversion circuit is kept at a constant value regardless of the gradations to be displayed. With this measure even when the D/A conversion circuit is operated near the D/A conversion time lower limit Tc or with a further slightly shorter conversion time with the result that a short voltage is induced, the voltage interval between the adjacent gradations is hardly varied, because the short voltages between the adjacent gradations are approximated to each other, and a possible deterioration of the picture quality hardly occurs. Thereby, the picture quality is improved and a multi-gradation display can easily be achieved. Further, the conversion time in the D/A conversion circuit can be shortened, and a high resolution can also be achieved.

A liquid crystal display device according to the present invention comprises a pair of substrates at least one of which is transparent, a liquid crystal layer sandwiched between the substrates, a display region and a peripheral circuit for driving the display region, both of which are mounted on one of the pair of substrates. The display region is formed by a plurality of drain lines and a plurality of gate lines arranged in a matrix shape, and a plurality of thin film transistors are each disposed near the respective cross points of the matrix. The peripheral circuit is provided with a driving circuit which is signed to receive digital image signal inputs. The driving circuit is provided with a plurality of D/A conversion circuits, each being constituted by a plurality of switches, each having substantially the same ON resistance, and a control unit which controls ON and OFF operation of the switches in such a manner that, at the time of a D/A conversion operation, a plurality of switches in a corresponding number are turned ON for respective input signals representing respective gradations.

In the above-described liquid crystal display device, the D/A conversion circuit can be constituted by a plurality of switch groups, each being constituted by a plurality of switches connected in parallel. One of the terminals of each of the respective switch groups is respectively connected to different wiring lines for supplying respectively different reference voltages, the other terminals of the switch groups are connected in common to constitute a voltage output portion, and the control unit operates to turn ON a predetermined number n of switches among one or two of the switch groups.

Further, it is preferable to maintain the following relationship with respect to a range of unevenness of the ON resistance of the switches;

$$r/R<2/n$$

wherein, R represents a center value of ON resistances of the switches, r represents the difference between the maximum value and the minimum value of the ON resistances of the switches and n represents the number of switches being turned ON at the same time, as referred to above.

Still further, when assuming that the number of switch groups is m and the voltage at the voltage output portion varies in Z steps, it is preferable that one of the switch groups is constituted by (n−1) switches and each of the remaining (m−1) switch groups is constituted by n switches, wherein both (m−1) and n are a power of 2 and a relationship of Z=(m−1)x n is maintained.

Still further, it is preferable that the control unit operates to turn ON all of the switches belonging to one switch group in an early stage of the D/A conversion time.

Still further, between the D/A conversion circuit and the drain lines, a distribution circuit can be provided which distributes the output voltages of the D/A conversion circuit to a plurality of drain lines.

Still further, a pre-charge circuit can be provided which applies a voltage to the drain lines for every horizontal one line period.

Moreover, in the above variety of arrangements, the switch, can be constituted either by a single thin film transistor or by a parallel connection of a plurality of thin film transistors, the source electrodes and drain electrodes of which are respectively connected in common or by series connection of a thin film transistor and a resistor.

BRIEF DESCRIPTION OF THE DRAWINGS

FIG. 3 is a diagram showing an exemplary operation performed in a control circuit in the D/A conversion circuit in the FIG. 1 embodiment;

FIG. 14 is a diagram showing another exemplary operation performed in a control circuit in the D/A conversion circuit in the FIG. 11 embodiment;

DETAILED DESCRIPTION OF THE PREFERRED EMBODIMENTS

Figure 1:
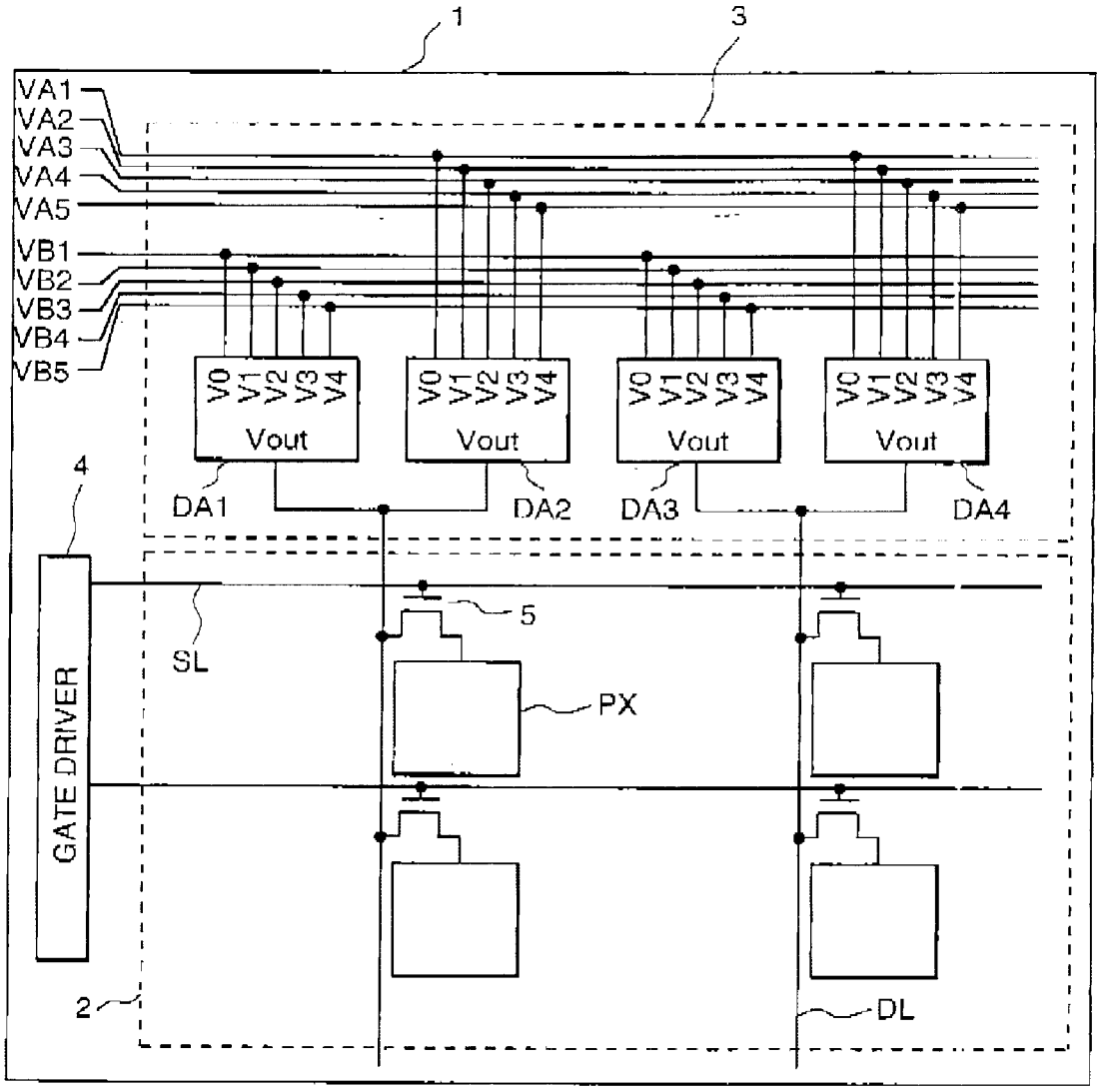
FIG. 1 is a block diagram of a liquid crystal display device representing a first embodiment according to the present invention.

FIG. 1 is a diagram showing the constitution of a liquid crystal display device representing a first embodiment of the present invention. As illustrated in the drawing, on the surface of an insulating substrate 1 in the liquid crystal display device, a display region 2, a drain driver 3 and a gate driver 4 are provided.

The display region 2 is constituted by drain lines DL and gate lines SL, which are arranged in a matrix shape, and pixel TFTs (Thin Film Transistors) 5 and display electrodes PX, which are arranged for every intersection point of the drain lines DL and the gate lines SL.

Further, in FIG. 1, in order to facilitate understanding of the constitution of the liquid crystal display device, only two drain lines DL and two gate lines SL are illustrated. However, in an actual liquid crystal display device, for example, of VGA type (Video Graphic Array) having 640×480×RGB (Red, Green, Blue) pixels, the number of the gate lines SL is 480 and the number of drain lines DL is 1920.

The drain driver 3 is constituted by TFTs and is provided with D/A conversion circuits DA1 through DA4. To one drain line DL, a pair of D/A conversion circuits, for example, DA1 and DA2, are connected, and to the pair of D/A conversion circuits DA1 and DA2, reference voltage distribution lines VA1 through VA5 and VB1 through VB5 are respectively connected.

To the reference voltage distribution lines VA1 through VA5, reference voltages in a higher range of the liquid crystal drive voltage are supplied, and to the reference voltage distribution lines VB1 through VB5, reference voltages in a lower range of the liquid crystal drive voltage are supplied. When generating voltages in the higher range of liquid crystal drive voltage at the drain line DL, the D/A conversion circuits DA2 and DA4 are operated, and when generating voltages in the lower range of the liquid crystal drive voltage at the drain line DL, the D/A conversion circuits DA1 and DA3 are operated. Thereby, the liquid crystal panel is AC-driven.

The gate driver 4 is constituted by TFTs and is connected, to all of the gate lines SL. The gate driver 4 turns ON a pixel TFT 5 connected to a specific gate line SL and determines a display electrode PX which samples a voltage at the drain line DL.

Now, the circuit arrangement of the D/A conversion circuits DA1 through DA4 will be explained.

Figure 2:
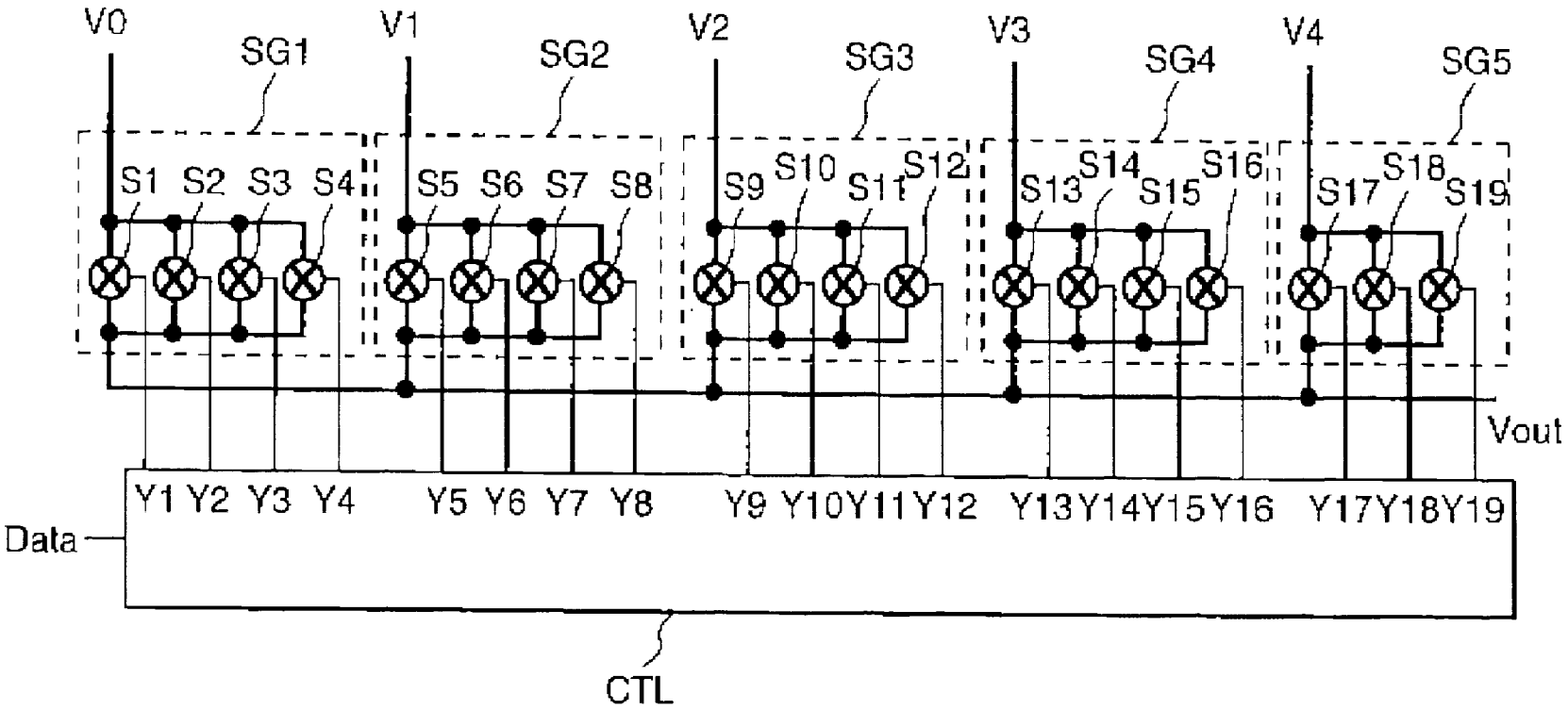
FIG. 2 is a schematic circuit diagram showing a D/A conversion circuit used in the FIG. 1 embodiment.

FIG. 2 is a circuit diagram showing a circuit arrangement of one of the D/A conversion circuits DA1 through DA4, for example, DA1. The D/A conversion circuit DA1 is a circuit with 4 bit inputs and 16 gradation outputs. Of course, the number of bits and gradations of the D/A conversion circuit is not limited to these specific numbers.

As illustrated in the drawing, the D/A conversion circuit DA1 is constituted by switches S1 through S19 and a control circuit CTL which controls ON and OFF operation of the switches S1 through S19.

The switches S1 through S4 are connected in parallel by connecting respective input and output terminals in common and constitute a switch group SG1. Similarly, the switches S5 through S8 constitute a switch group SG2, the switches S9 through S12 constitute a switch group SG3, the switches S13 through S16 constitute a switch group SG4 and the switches S17 through S19 constitute a switch group SG5.

Input terminals of the switch groups SG1 through SG5 are respectively connected to reference voltage input terminals V0 through V4, and all of the output terminals of the switch groups SG1 through SG5 are connected in common and are connected to an output terminal Vout.

Further, the switches S1 through S19 are connected to output terminals Y1 through Y19 of the control circuit CTL. The outputs from the output terminals Y1 through Y19 are binary logic signals through which the ON and OFF operation of the switches S1 through S19 are controlled.

To the control circuit CTL 4, bit data signals and an output enable signal EN (not shown) are inputted. The control circuit CTL varies the outputs at the output terminals Y1 through Y19 according to image signals inputted to the 4 bit data signal lines and the output enable signal EN, and thereby controls ON/OFF operation of the switches S1 through S19.

FIG. 3 is a diagram showing an example of the operation of the control circuit CTL. As illustrated in the drawing, when the input signal data is 0, the control circuit CTL outputs signals to the output terminals Y1 through Y19 to turn ON switches S1 through S4 and turn OFF all of the other switches, whereas, when the input signal data is 1, the control circuit CTL outputs signals to the output terminals Y1 through Y19 to turn ON the switches S2 through S5 and turn OFF all of the other switches. Namely, when the input signal data is k (k=0–15), the control circuit CTL outputs signals to the output terminals Y1 through Y19 to turn ON specific ones of four successive switches Sk+1 through Sk+4 and to turn OFF all of the other remaining switches.

Further, the above operations occur when the output enable signal EN=1, however, when EN=0, the control circuit CTL outputs signals to the output terminals Y1 through Y19 to turn OFF all of the switches S1 through S19. Thereby, the output terminal Vout is cut off from the reference voltages and the function of the D/A conversion circuit is inhibited. As illustrated in FIG. 1, since a pair of D/A conversion circuits are connected to a single drain line DL, by alternately operating the two D/A conversion circuits using the output enable signal EN, the voltage supplied to the drain line is alternated between the higher and lower ranges.

Now, a relationship between input signal Data, output voltage and output resistance in the D/A conversion circuits DA1 through DA4 will be explained.

Figure 4A:
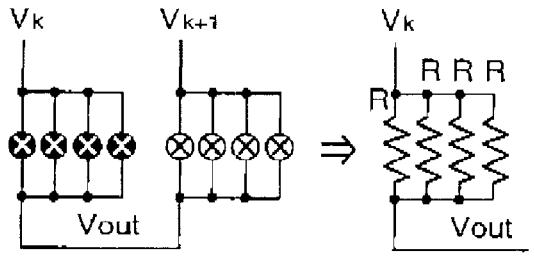
FIGS. 4A through 4D are diagrams which may be used to illustrated the manner of voltage generation in a D/A conversion circuit in a liquid crystal display device according to the present invention.

FIGS. 4A through 4D are diagrams illustrating the relationship between input signal data, output voltage and output resistance in the D/A conversion circuits DA1 through DA4, wherein the ON resistance value of one switch is assumed as R. When the output signal data represents multiples of 4, namely, 4×k (k=[0, 1, 2, 3]), Vk and Vout are connected by four switches connected in parallel as shown in FIG. 4A. The voltage Vout assumes the value Vk, and the output resistance of Vout is R/4.

Figure 4B:
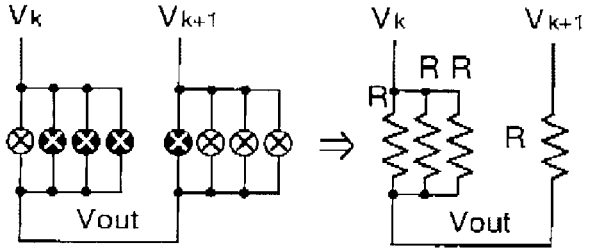
Figure 4C:
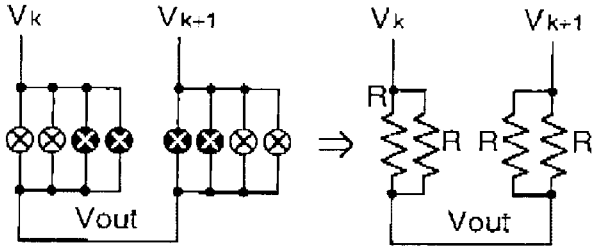
Figure 4D:
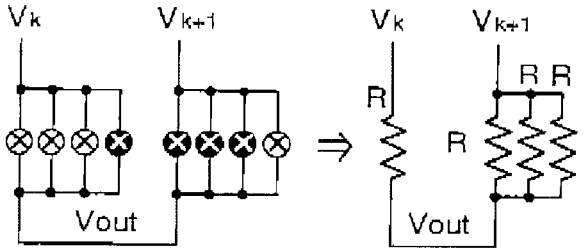

When the output signal data are not multiples of 4, in that 4×k+j (k=[0, 1, 2, 3], j=[1, 2, 3]), the voltage Vout assumes a value determined by dividing Vk and Vk+1 by a resistance as illustrated in FIGS. 4B through 4D to assume Vout={(4−j)×Vk+j×V(k+1)}¼. The output resistance of Vout in these instances also gives R/4.

Namely, at the output terminal Vout, voltages determined by equally dividing the two reference voltages into four are generated, therefore, each of the D/A conversion circuits DA1 through DA4 can generate 16 gradation voltages from the five reference voltages, in other words, they can generate more gradation voltages than the number of reference voltages. Further, in these instances, the output resistance of the D/A conversion circuit is reduced to R/4 which is smaller than the ON resistance of a single switch. Still further, the output resistance of the respective D/A conversion circuits always is R/4 regardless of the input signals representing gradations to be displayed.

When the ON resistance values of the switches constituting the D/A conversion circuits DA1 through DA4 vary due to errors during manufacture thereof, error voltages are induced. These error voltages may cause a gradation inversion in the display image of the liquid crystal display device, and deteriorate the image quality. Herein, the term gradation inversion implies a phenomena in which an inverted portion is generated in a relationship between dark and bright with regard to the gradation to be displayed.

Figure 5:
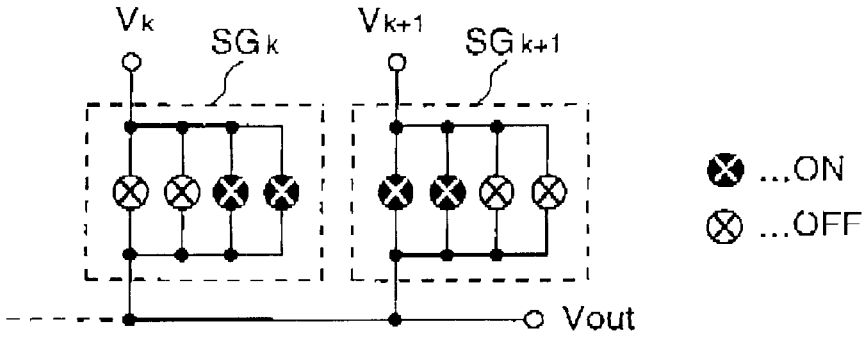
FIG. 5 is a diagram illustrating a case in which an error voltage maximizes in the D/A conversion circuit in the liquid crystal display device according to the present invention.

An instance when such an error voltage is maximized is represented by the following case illustrated in FIG. 5, in which a half number of switches n/2 in two switch groups each constituted by n switches are turned ON, and the ON resistance of one of the two switch groups assumes a minimum value and the other of the two switch groups assumes a maximum value.

Figure 6A:
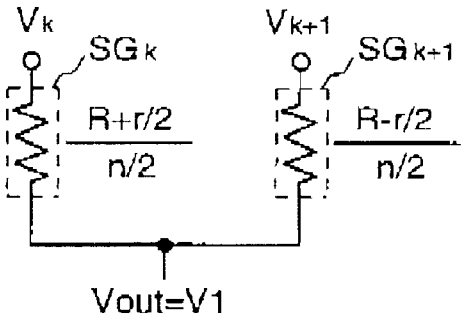
FIGS. 6A and 6B are diagrams showing the resistances in switch groups in a case in which an error voltage maximizes in the D/A conversion circuit in the liquid crystal display device according to the present invention.
Figure 6B:
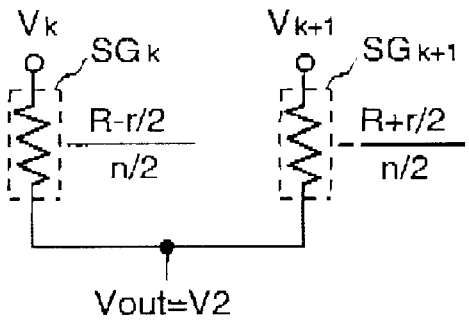

When assuming that a center value of the ON resistances of the switches is R and the difference between the maximum ON resistance value and the minimum ON resistance value is r, and expressing the maximum ON resistance value as (R+r/2) and the minimum ON resistance value as (R−r/2), the resistance values of the two switch groups are given respectively as (R−r/2)/(n/2) and (R+r/2)/(n/2). FIGS. 6A and 6B show two cases in which the resistances of two switch groups give the above values. Namely, in FIG. 6A, the resistance of the switch group SGk connected to the reference voltage Vk is (R+r/2)/(n/2) and the resistance of the switch group SGk+1 connected to the reference voltage Vk+1 is (R−r/2)/(n/2); and, in FIG. 6B, the resistance of the switch group SGk connected to the reference voltage Vk is (R−r/2)/(2/n) and the resistance of the switch group SGk+1 connected to the reference voltage Vk+1 is (R+r/2)/(n/2).

Herein, when assuming that Vk<V(k+1), the output voltage Vout becomes the highest voltage (=V1) in the case as shown in FIG. 6A, and becomes the lowest voltage (=V2) in the case as shown in FIG. 6B. When assuming that Vk>V(k+1), the above relationship is inverted. In any case, the maximum error voltage being generated is given as |V2−V|=r/2Rx|Vk−V(k+1)|.

In order to prevent generation of gradation inversion, it is sufficient if the error voltage is kept low and at least below the voltage corresponding to one gradation. Since the voltage band corresponding to one gradation is |Vk−V(k+1)|/n, the condition which prevents generation of gradation inversion is r/R<2/n.

Figures 7, 8:
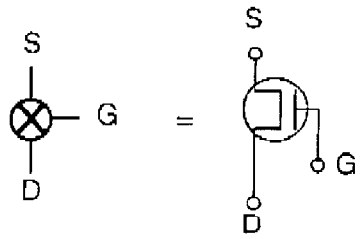
FIG. 7 is a diagram showing another exemplary operation performed in a control circuit in the D/A conversion circuit in the FIG. 1 embodiment.
FIG. 8 is an equivalent circuit diagram of a switch constituting a D/A conversion circuit in a liquid crystal display device according to the present invention.

FIG. 7 is a diagram showing another example of an operation performed by the control circuit CTL. In this example, S signals are inputted to the control circuit CTL in addition to the data signals and the EN signal. As illustrated, when S=0, the control circuit CTL outputs signals to the output terminals Y1 through Y19 so that only four specified switches Sk+1 through Sk+4 are turned ON with respect to Data signal=k(k=0–15), like the operation explained in connection with FIG. 3. On the other hand, when S=1, the control circuit CTL outputs signals to the output terminals Y1 through Y19 so that when Data signal=0~3, only the switches S1 through S4 are turned ON, when Data signal=4~7, only the switches S5 through S8 are turned ON, when Data signal=8~11, only the switches S9 through S12 are turned ON, and when Data signal=12~15, only the switches S13 through S16 are turned ON. Namely, when S=1, all of the switches belonging to one of the switch groups SG1 through SG4 which are respectively connected to one of the reference voltage input terminals V0~V3 are turned ON.

Further, the above operations are performed when the output enable signal EN=1, but in the case of EN=0, like the operation in FIG. 3, all of the switches S1 through S19 are tuned OFF regardless of the values of the S signal and Data signals.

In this operation, during the early half of the D/A conversion time, the control of S=1 is performed, and during the later half of the D/A conversion time, the control of S=0 is performed; as a result, thereby, during the early half of the D/A conversion time, a rough adjustment is performed to bring Vout close to a target output voltage, and during the later half of the D/A conversion time, a fine adjustment is performed to cause Vout to meet the target output voltage. Through this operation, during the early half of the D/A conversion time, only one of the reference voltages V0~V3 is activated and no current flows between the reference voltages, which saves unnecessary power consumption during this period.

Now, a relationship between the number of switches and the number of switch groups, which is convenient for processing binary input signal data, will be explained.

When assuming that the number of reference voltages supplied from outside is m, the number of the switch groups is also determined as m. When the number (m−1) is determined as a power of 2, the control circuit CTL can utilize a repeating structure which simplifies the circuit arrangement.

Further, when assuming that the number of switches which constitute one switch group is n, the number of gradations Z which can be generated with the switch groups m is expressed as Z=(m−1)xn+1. It is also convenient if the number of gradations Z assumes a power of 2, however, when (m−1) is determined as a power of 2, Z can not assume a power of 2. Therefore, if one of the switch groups is constituted by (n−1) switches and all of the remaining switch groups are respectively constituted by n piece of switches, the number of gradations, Z is given as Z=(m−1)×n, and if n is determined to be a proper value expressed by a power of 2, the number of gradations assumes a power of 2 which is convenient for binary data.

FIG. 8 is a diagram showing an example of a circuit arrangement of one of the switches S1 through S19. In this example, the switch is constituted by a single TFT. In order to equalize respective ON resistances of the switching TFTs, the channel width and length of the respective TFTs are equalized. Further, when P channel TFTs are used for the D/A conversion circuits DA2 and DA4, which cover a higher voltage range in the liquid crystal drive voltage, and n channel TFTs are used for the D/A conversion circuits DA1 and DA3, which cover a lower voltage range in the liquid crystal drive voltage, the ON resistances of the respective switches can further be reduced.

Figure 9:
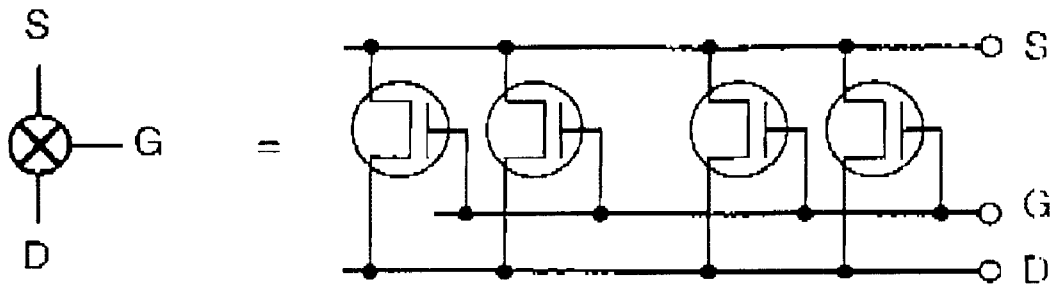
FIG. 9 is another equivalent circuit diagram of a switch for constituting a D/A conversion circuit in a liquid crystal display device according to the present invention.

FIG. 9 is a diagram showing another circuit arrangement of one of the switches S1 through S19. In this example, a plurality of TFTs are connected in parallel and the respective electrodes of the gates, sources and drains are connected in common. In order to equalize respective ON resistances of the switching TFTs, the channel width and length of the respective TFTs are similarly equalized. Further, when a plurality of TFTs are used, an unevenness of the ON resistances of the respective TFTs is averaged and a stable resistance value can be obtained, in contrast to what is obtained with the use of a single TFT.

Figure 10:
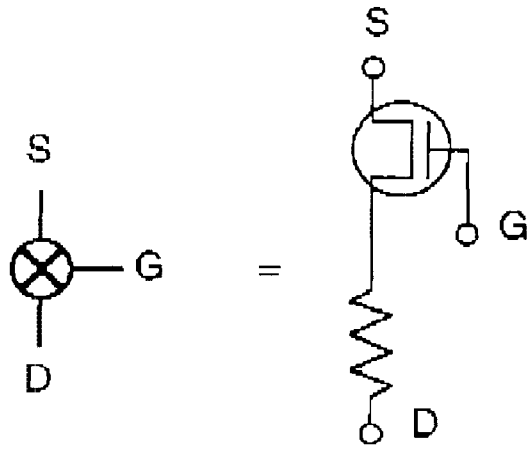
FIG. 10 is still another equivalent circuit diagram of a switch for constituting a D/A conversion circuit in a liquid crystal display device according to the present invention.

FIG. 10 is a diagram showing still another circuit arrangement of one of the switches S1 through S19. In this example, the switch is constituted by connecting in series a single TFT and a resistance element formed by a wiring material. In order to equalize the respective ON resistances of the switching TFTs, the channel width and length of the respective TFTs are similarly equalized. Through the series connection of the resistance element formed by the wiring material whose resistance value is stable, a stable resistance value can be obtained, in contrast to what is obtained with the use of a TFT alone. Further, even in this example, a plurality of TFTs connected in parallel, as shown in FIG. 9, can be used for the single TFT.

Figure 11:
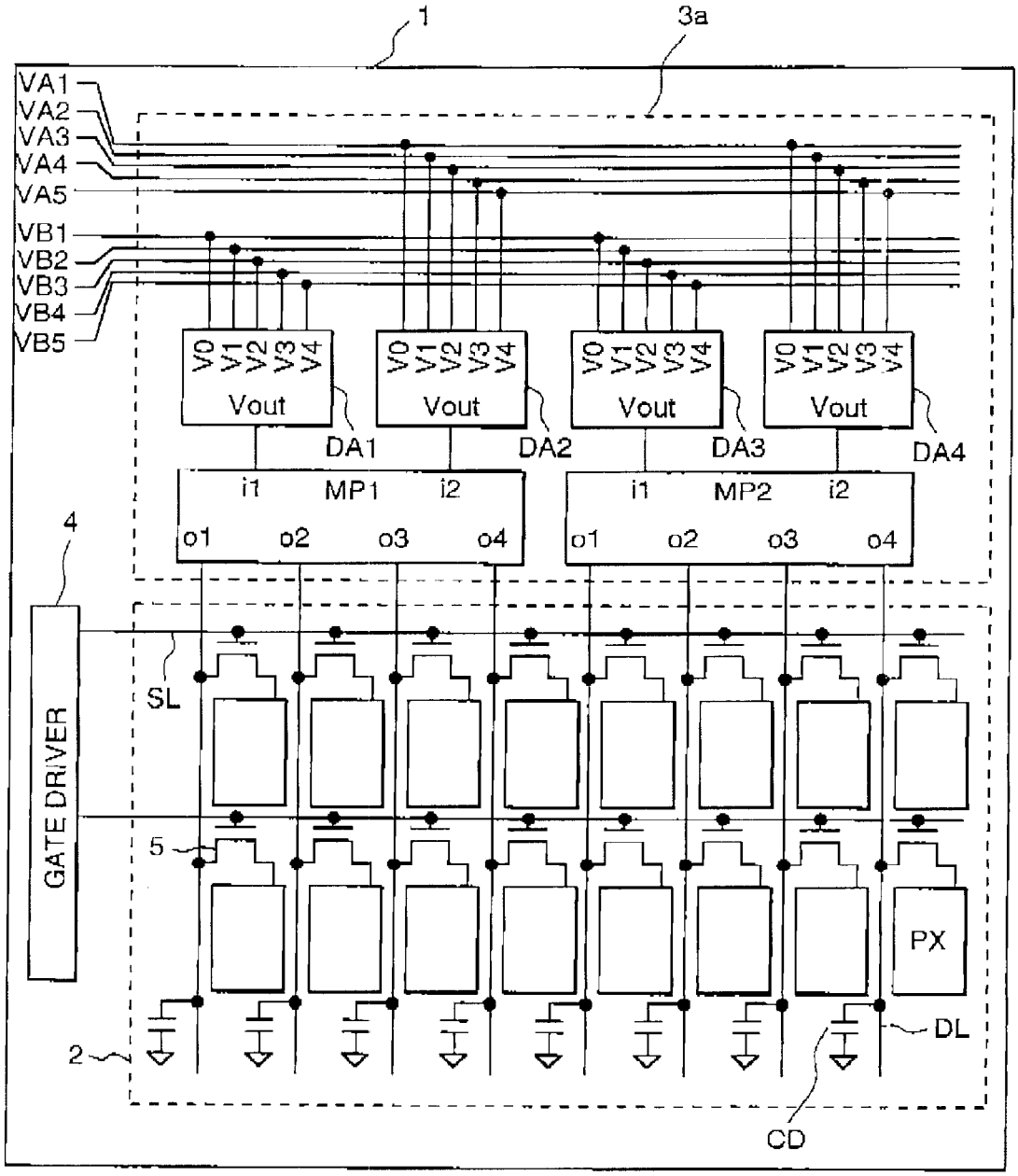
FIG. 11 is a block diagram of a liquid crystal display device representing a second embodiment according to the present invention.

FIG. 11 is a block diagram showing a circuit arrangement of a liquid crystal display device representing a second embodiment of the present invention.

The circuit arrangement of the present liquid crystal display device is basically the same as FIG. 1 embodiment except for the circuit arrangement of the drain driver.

As shown in FIG. 11, the drain driver 3*a* in the present liquid crystal display device is constituted by D/A conversion circuits DA1 through DA4 and distribution circuits MP1 and MP2. In other words, the drain driver 3*a* is constituted by adding the distribution circuits MP1 and MP2 to the drain driver circuit 3 in the FIG. 1 embodiment.

The circuit arrangement of the D/A conversion circuits DA1 through DA4 is the same as that shown in FIG. 2 for the FIG. 1 embodiment. Further, like the FIG. 1 embodiment, reference voltages in a lower range of the liquid crystal drive voltage are supplied to the D/A conversion circuits DA1 and DA3 via the reference voltage distribution lines VB1~VB5, and reference voltages in a higher range of the liquid crystal drive voltage are supplied to the D/A conversion circuits DA2 and DA4 via the reference voltage distribution lines VA1~VA5.

The voltages generated by the D/A conversion circuits DA1~DA4 are distributed by the distribution circuits MP1 and MP2 to a plurality of drain lines DL. The distributed voltage is first held by the capacity CD of the drain lines. The voltage held by the capacity CD is sampled via a pixel TFT 5, which is turned ON by the gate driver 4 by a corresponding display electrode PX.

The distribution circuits MP1 and MP2 output a voltage which is received at input terminal i1 or i2 to one of the output terminals o1~o4 according to a control signal. In the circuit arrangement as shown in FIG. 11, when driving a drain line DL with a voltage in a lower range of the liquid crystal drive voltage, the voltage received at the input terminal i1 is outputted to one of the output terminals o1~o4, and when driving a drain line DL with a voltage in a high range of the liquid crystal drive voltage, the voltage received at the input terminal i2 is outputted to one of the output terminals o1~o4.

Further, when the D/A conversion circuit outputs a voltage to be outputted to a drain line DL connected to the output terminal o1, a voltage received at input terminal i1 or i2 is outputted to the output terminal o1; when the D/A conversion circuit outputs a voltage to be outputted to a drain line DL connected to the output terminal o2, a voltage received at input terminal i1 or i2 is outputted to the output terminal o2; when the D/A conversion circuit outputs a voltage to be outputted to a drain line DL connected to the output terminal o3, a voltage received at input terminal i1 or i2 is outputted to the output terminal o3; and when the D/A conversion circuit outputs a voltage to be outputted to a drain line DL connected to the output terminal o4, a voltage received at input terminal i1 or i2 is outputted to the output terminal o4. Namely, in this embodiment, the D/A conversion circuits are used in a time sharing manner, and each serves four drain lines.

Figures 12, 13:
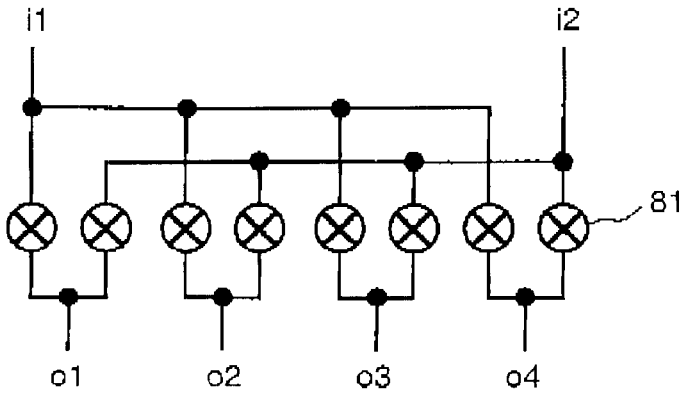
FIG. 12 is a schematic circuit diagram of a distribution circuit used in the FIG. 11 embodiment.
FIG. 13 is a diagram showing an exemplary operation performed in a control circuit in the D/A conversion circuit in the FIG. 11 embodiment.

FIG. 12 shows a circuit diagram of one of the distribution circuits MP1 and MP2. As shown in the drawing, the present distribution circuit is constituted by a plurality of switches 81 which are connected in such a manner that all of the input terminals i1 and i2 are connected to all of the output terminals o1~o4. Through the use of these distribution circuits, a plurality of drain lines DL can be driven by one D/A conversion circuit, therefore, the number of D/A conversion circuits can be reduced.

FIG. 13 is a diagram showing an example of an operation performed by the control circuit CTL. As illustrated in the drawing, when input signal Data is k (k=0~15), only four successive switches Sk+1~Sk+4 are turned ON and all of the remaining switches are turned OFF. Namely, the same operation as performed in FIG. 3 when EN=1 is performed here. As has been explained previously, in the present embodiment, the change-over of the D/A conversion circuits, for example, between DA1 and DA2 is performed in the distribution circuits MP1 and MP2, therefore, the EN signal control in the control circuit is unnecessary.

In the case of this second embodiment, as the capacitive load of the D/A conversion circuit, the parasitic capacitances of the TFTs constituting the switches in the D/A conversion circuits and the distribution circuits and the capacitances CD of the drain lines are included. When the capacitances CD of the drain lines are equal to or larger than the total f the parasitic capacitances of the TFTs constituting the switches in the D/A conversion circuits and the distribution circuits, the capacitances CD of the drain lines become dominant, and, therefore, it becomes necessary to make the ON resistances of the switches 81 constituting the distribution circuits substantially equal to each other.

In the distribution circuit as shown in FIG. 12, since all of the resistances between any of the input terminals and output terminals are represented by the ON resistance of a single switch, the output resistance as seen from the drain lines is always constant regardless of the input signals representing gradations to be displayed and the routes of distribution.

On the other hand, when the total of the parasitic capacitances of the TFTs constituting the switches in the D/A conversion circuits and the distribution circuits are overwhelmingly larger than the capacitances CD of the drain lines, the capacitances of the drain lines can be neglected, therefore, no limitation as indicated above with regard to the ON resistances of the switches in the distribution circuits is required.

FIG. 14 is a diagram showing another example of an operation of the control circuit CTL. As illustrated in the drawing, when S=0, only four successive switches Sk+1~Sk+4 are turned ON for Data signal k (k=0~15). Further, when S=0, with Data 0~3, only the switches S1~S4 are turned ON, with Data=4~7, only the switches S5~S8 are turned ON, with Data=8~11, only the switches S9~S11 are turned ON, and with Data=12~15, only the switches S13~S16 are turned ON. Namely, this is the same operation as in FIG. 7 when EN=1. As has been explained previously, in the present embodiment, the change-over of the D/A conversion circuits, for example, between DA1 and DA2, is performed in the distribution circuits MP1 and MP2, therefore, the EN signal control in the control circuit is unnecessary.

Figure 15:
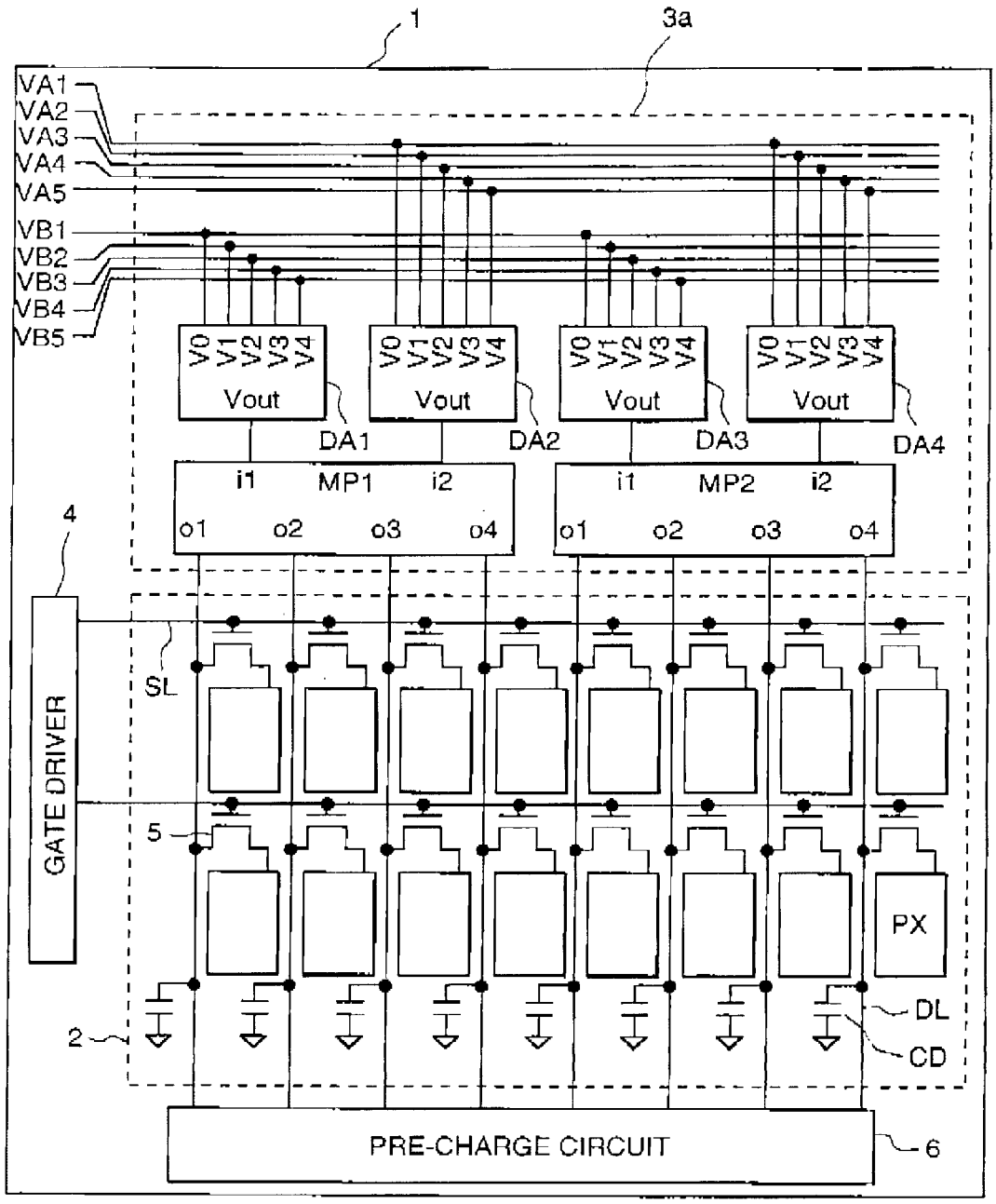
FIG. 15 is a block diagram of a liquid crystal display device representing a third embodiment according to the present invention.
Figure 16A:
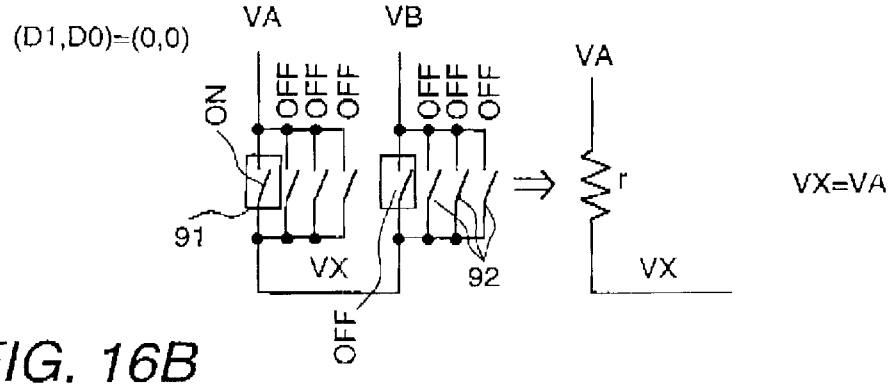
FIGS. 16A through 16D are diagrams which may be used to illustrate an operating principle of a D/A conversion circuit in a conventional liquid crystal display device.
Figure 16B:
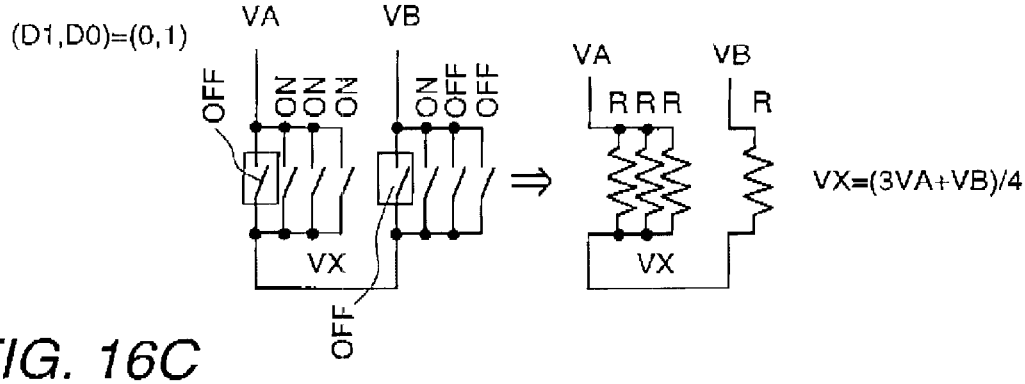
Figure 16C:
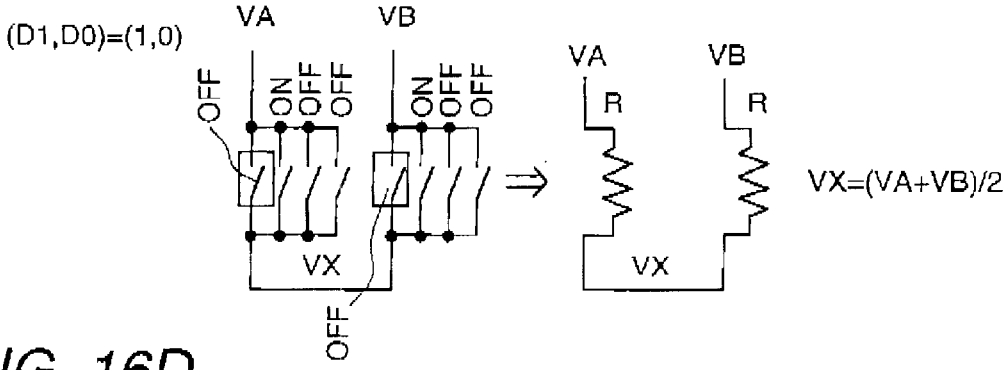
Figure 16D:
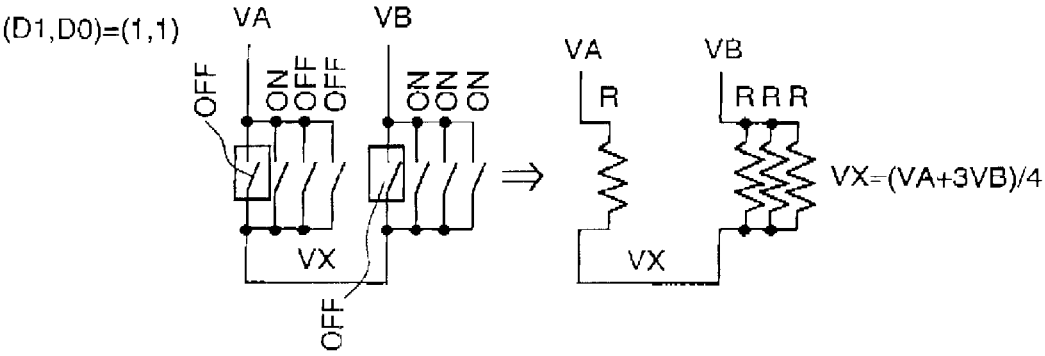
Figure 17:
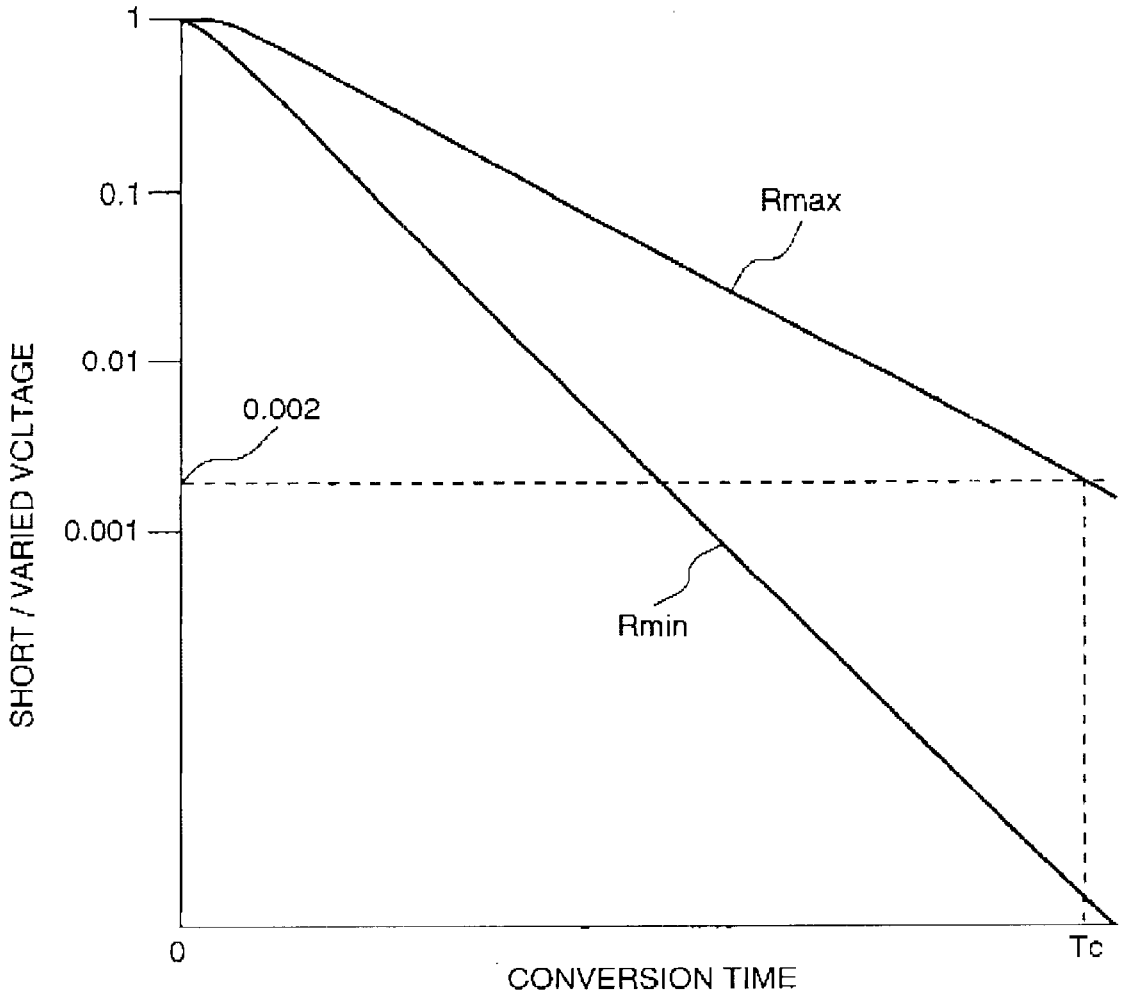
FIG. 17 is a diagram for explaining a manner of change of short voltages with respect to conversion time when output resistances in a D/A conversion circuit differ.

FIG. 15 is a circuit diagram showing a circuit arrangement of a liquid crystal display device representing a third embodiment of the present invention. The present embodiment is constituted by adding a pre-charge circuit to the second embodiment as shown in FIG. 11. Other constituting elements of the present embodiment are the same as those in FIG. 11 embodiment. The pre-charge circuit 6 is connected to all of the drain lines and pre-charges the drain lines with a predetermined voltage for every horizontal one line period.

In the present embodiment the drain lines are pre-charged to a predetermined voltage by the pre-charge circuit 6, and, thereafter, the drain lines are charged by the D/A conversion circuit to a target voltage, therefore, a varying voltage band is kept constant for every gradation. Accordingly, the variation of the short voltage is further reduced in comparison with the second embodiment shown in FIG. 11.

As has been explained hitherto, according to the present invention, a plurality of switches constituting D/A conversion circuits incorporated in a liquid crystal display device are turned ON at the same time, and the number of switches which are turned on at the same time is constant regardless of the input signals representing gradations; therefore, the output resistances of the respective D/A conversion circuits become constant and are smaller than the ON resistance of one of the switches, and, additionally, the unevenness of the short voltage of the D/A conversion circuits is reduced in comparison with the conventional arrangement. Thereby, an improvement in image quality and multi-gradation are easily achieved in comparison with the conventional arrangement. Moreover, the D/A conversion time can be shortened, thereby, a high resolution in a liquid crystal display device can be easily achieved.

What is claimed is:

1. A liquid crystal display device comprising a pair of substrates at least one of which is transparent; a liquid crystal layer sandwiched between the substrates; a display region; and a periphery circuit for driving the display region both of which are mounted on one of the pair of substrates, the display region being formed by a plurality of drain lines and a plurality of gate lines arranged in a matrix shape and a plurality of thin film transistors each being disposed near the respective related matrixes and the periphery circuit being provided with a driving circuit which is permitted to receive digital image signal inputs, wherein the driving circuit is provided with a plurality of D/A conversion circuits each being constituted by a plurality of switches each having substantially the same ON resistance and a control circuit which controls ON and OFF of the switches in such a manner that at a time of D/A conversion operation a plurality of switches in same number are turned ON for respective input signals representing respective gradations; wherein the D/A conversion circuit is constituted by a plurality of switch groups each being constituted by a plurality of switches connected in parallel, one terminals of the respective switch groups are respectively connected to different distribution lines being supplied of respectively different reference voltages, the other terminals of the switch groups are connected in common to constitute a voltage output portion, and the control circuit controls to turn ON a predetermined plurality number n of switches among one or two of the switch groups at the same time during D/A conversion operation.

2. A liquid crystal display device according to claim 1, wherein a range of unevenness of the ON resistances of the switches is kept in the following condition;

$$r/R<2/n$$

wherein, R represents a center value of ON resistances of the switches, r represents difference between the maximum value and the minimum value of ON resistances of the switches and n represents number of switches being turned ON at the same time during D/A conversion operation.

3. A liquid crystal display device according to claim 2, wherein when assuming the number of switch groups is m and the voltage at the voltage output portion varies in Z steps, one of the switch groups of m is constituted by (n−1) pieces of switches and each of the remaining (m−1) pieces of switch groups is constituted by n pieces of switches and further both (m−1) and n are a power of 2 and the voltage steps Z are expressed as Z=(m−1)×n.

4. A liquid crystal display device according to claim 2, wherein the control circuit controls to turn ON all of the switches belonging to one switch group in an early stage of the D/A conversion time.

5. A liquid crystal display device according to claim 2, wherein between the D/A conversion circuit and the drain lines a distribution circuit is further provided which distributes the output voltages of the D/A conversion circuit to a plurality of drain lines.

6. A liquid crystal display device according to claim 2, wherein a pre-charge circuit is further provided which applies a voltage to the drain lines for every horizontal one line period.

7. A liquid crystal display device according to claim 2, wherein each of the switches is constituted by a parallel connection of a plurality of thin film transistors of which source electrodes and drain electrodes are respectively connected in common.

8. A liquid crystal display device according to claim 2, wherein each of the switches is constituted by a series connection of a thin film transistor and a resistor.

9. A liquid crystal display device according to claim 1, wherein when assuming the number of switch groups is m and the voltage at the voltage output portion varies in Z steps, one of the switch groups of m is constituted by (n−1) pieces of switches and each of the remaining (m−1) pieces of switch groups is constituted by n pieces of switches and further both (m−1) and n are a power of 2 and the voltage steps Z are expressed as Z=(m−1)×n.

10. A liquid crystal display device according to claim 9, wherein the control circuit controls to turn ON all of the switches belonging to one switch group in an early stage of the D/A conversion time.

11. A liquid crystal display device according to claim 9, wherein between the D/A conversion circuit and the drain lines a distribution circuit is further provided which distributes the output voltages of the D/A conversion circuit to a plurality of drain lines.

12. A liquid crystal display device according to claim 9, wherein a pre-charge circuit is further provided which applies a voltage to the drain lines for every horizontal one line period.

13. A liquid crystal display device according to claim 9, wherein each of the switches is constituted by a parallel connection of a plurality of thin film transistors of which source electrodes and drain electrodes are respectively connected in common.

14. A liquid crystal display device according to claim 9, wherein each of the switches is constituted by a series connection of a thin film transistor and a resistor.

15. A liquid crystal display device according to claim 1, wherein the control circuit controls to turn ON all of the switches belonging to one switch group in an early stage of the D/A conversion time.

16. A liquid crystal display device according to claim 15, wherein between the D/A conversion circuit and the drain lines a distribution circuit is further provided which distributes the output voltages of the D/A conversion circuit to a plurality of drain lines.

17. A liquid crystal display device according to claim 15, wherein a pre-charge circuit is further provided which applies a voltage to the drain lines for every horizontal one line period.

18. A liquid crystal display device according to claim 15, wherein each of the switches is constituted by a parallel connection of a plurality of thin film transistors of which source electrodes and drain electrodes are respectively connected in common.

19. A liquid crystal display device according to claim 15, wherein each of the switches is constituted by a series connection of a thin film transistor and a resistor.

20. A liquid crystal display device according to claim 1, wherein between the D/A conversion circuit and the drain lines a distribution circuit is further provided which distributes the output voltages of the D/A conversion circuit to a plurality of drain lines.

21. A liquid crystal display device according to claim 1, wherein a pre-charge circuit is further provided which applies a voltage to the drain lines for every horizontal one line period.

22. A liquid crystal display device according to claim 1, wherein each of the switches is constituted by a parallel connection of a plurality of thin film transistors of which source electrodes and drain electrodes are respectively connected in common.

23. A liquid crystal display device according to claim 1, wherein each of the switches is constituted by a series connection of a thin film transistor and a resistor.

24. A liquid crystal display device comprising:

a pair of substrates at least one of which is transparent;

a liquid crystal layer sandwiched between the pair of substrates;

a display region being formed on one of the pair of substrates and being constituted by a plurality of drain lines and a plurality of gate lines arranged in a matrix shape and a plurality of thin film transistors each being disposed in connection with respective relating matrixes defined by the plurality of drain lines and the plurality of gate lines and a plurality of display electrodes each being related to the respective thin film transistors; and a periphery driving circuit which drives the display region and includes a drain driver connected to the plurality of drain lines, a gate driver connected to the plurality of gate lines and a precharge circuit connected to the plurality of drain lines which applies a predetermined pre-charging voltage to the plurality of drain lines for every horizontal one line period, wherein, the drain driver comprises a plurality of pairs of first and second D/A conversion circuits and a plurality of distribution circuits each of which input terminals are connected to one of the pairs of first and second D/A conversion circuits and each of which output terminals are connected to a predetermined plurality number of the drain lines, the first D/A conversion circuit being connected to a plurality of reference voltages in a lower range of liquid crystal drive voltage and outputting gradation voltages in response to digital input signals representing gradations to be displayed and the second D/A conversion circuit being connected to a plurality of reference voltages in a higher range of liquid crystal drive voltage and outputting gradation voltages in response to digital input signals representing gradations to be displayed, the pair of first and second D/A conversion circuits in combination apply an AC voltage to the liquid crystal layer, each of the distribution circuit is constituted by a plurality of switching thin film transistors each having substantially the same ON resistance and any combination of the plurality of input terminals and the plurality of output terminals is established through turning on one of the plurality of the switching thin film transistors.

25. A liquid crystal display device according to claim 24, wherein each of the first and second D/A conversion circuits is constituted by a plurality of switching thin film transistors each having substantially the same ON resistance and a control circuit which performs ON and OFF control of the plurality of switching thin film transistors in such a manner that during D/A conversion operation a predetermined same plurality number of switching thin film transistors are turned ON for any input signals representing gradations to be displayed.

26. A liquid crystal display device according to claim 24, wherein each of the first and second D/A conversion circuits is constituted by a plurality of switching thin film transistors each having substantially the same channel width and length and a control circuit which performs ON and OFF control of the plurality of switching thin film transistors in such a manner that during D/A conversion operation a predetermined same plurality number of switching thin film transistors are turned ON for any input signals representing gradations to be displayed.

* * * * *